US008104267B2

(12) United States Patent
Kimura

(10) Patent No.: US 8,104,267 B2
(45) Date of Patent: Jan. 31, 2012

(54) EXHAUST EMISSION CONTROL DEVICE

(75) Inventor: Masahiro Kimura, Hino (JP)

(73) Assignee: Hino Motors, Ltd., Hino-shi (JP)

( * ) Notice: Subject to any disclaimer, the term of this patent is extended or adjusted under 35 U.S.C. 154(b) by 284 days.

(21) Appl. No.: 12/529,245

(22) PCT Filed: Aug. 7, 2008

(86) PCT No.: PCT/JP2008/002139

§ 371 (c)(1),
(2), (4) Date: Aug. 31, 2009

(87) PCT Pub. No.: WO2009/019875

PCT Pub. Date: Feb. 12, 2009

(65) Prior Publication Data

US 2010/0107618 A1 May 6, 2010

(30) Foreign Application Priority Data

Aug. 8, 2007 (JP) ..... 2007-206100

(51) Int. Cl.
*F01N 3/24* (2006.01)

(52) U.S. Cl. ..... 60/276

(58) Field of Classification Search ..... 60/276, 60/296, 297, 301, 317
See application file for complete search history.

(56) References Cited

U.S. PATENT DOCUMENTS

| | | | |
|---|---|---|---|
| 2001/0054309 | A1 | 12/2001 | Ohmori et al. |
| 2006/0065041 | A1 | 3/2006 | Kono et al. |
| 2007/0012035 | A1 | 1/2007 | Amemiya et al. |
| 2008/0072580 | A1 | 3/2008 | Nagaoka et al. |

FOREIGN PATENT DOCUMENTS

| | | | |
|---|---|---|---|
| DE | 10 2005 016 645 | A1 | 10/2006 |
| EP | 1 643 108 | A1 | 4/2006 |
| JP | 2-283813 | | 11/1990 |
| JP | 2002-54433 | | 2/2002 |
| JP | 2005 155404 | | 6/2005 |
| JP | 2005 273580 | | 10/2005 |
| WO | 2006 027904 | | 3/2006 |

OTHER PUBLICATIONS

Supplementary European Search Report issued Jan. 21, 2011, in European Patent Application No. 08 82 7129.

*Primary Examiner* — Thomas Denion
*Assistant Examiner* — Jonathan Matthias
(74) *Attorney, Agent, or Firm* — Oblon, Spivak, McClelland, Maier & Neustadt, L.L.P.

(57) ABSTRACT

Provided is an exhaust emission control device with a sensor arranged at a position where no erroneous detection of data occurs.

Provided are a casing which encases a catalyst carrier, a mixing pipe, a dispersion chamber which guides exhaust flowing in the mixing pipe to an exhaust inlet end of the casing, and a sensor. Attachment position of the sensor to the casing is set to a part region of a 360° region around a casing axis when viewed from an exhaust inlet end of the casing, the part region being opposite to the mixing pipe with respect to a border line which is perpendicular to an exhaust-flow center line connecting axes of the mixing pipe and of the casing and which crosses the axis of the casing diametrically of the casing.

2 Claims, 3 Drawing Sheets

EXHAUST EMISSION CONTROL DEVICE

TECHNICAL FIELD

The present invention relates to an exhaust emission control device.

BACKGROUND ART

Recently, there has been proposed to incorporate a filter for capture of particulates in exhaust in an engine exhaust system and to arrange a selective reduction catalyst capable of selectively reacting $NO_x$ with ammonia even in the presence of oxygen in the same engine exhaust system and downstream of the filter, urea water for reduction being added between the filter and the selective reduction catalyst so as to capture the particulates and reduce the $NO_x$.

When such a way is to be employed, a distance from the added position of the urea water to the selective reduction catalyst must be prolonged to sufficiently ensure time for thermal decomposition of the urea water added to the exhaust into ammonia and carbon dioxide. However, such axially aligned arrangement of the filter and the selective reduction catalyst substantially impairs mountability on a vehicle.

Then, the applicant has already proposed in Japanese patent application No. 2007-29923 an exhaust emission control device as shown in FIGS. 1 and 2 which has excellent mountability on a vehicle and which can prolong a distance from added position of urea water to selective reduction catalyst.

In the proposed exhaust emission control device, a casing 7 encasing a filter 5 for capture of particulates and a casing 8 encasing a selective reduction catalyst 6 for reduction of $NO_x$ are arranged side by side in such a manner that exhaust 3 has the same flow direction in the respective casings, an exhaust inlet end of the casing 7 being connected to an exhaust pipe 4 contiguous with an exhaust manifold 2 of a diesel engine 1, an exhaust outlet end of the casing 7 being connected to an exhaust inlet end of the casing 8 through a communication passage 9.

The casing 7 encasing the filter 5 extends in a fore-and-aft direction of a vehicle (truck) and is arranged closely adjacent to a side of a side member in a frame; the casing 8 encasing the selective reduction catalyst 6 extends in the fore-and-aft direction of the vehicle and is arranged closely adjacent to a bottom of a bed or rear deck so as to be positioned laterally external of the casing 7 in the vehicle.

The communication passage 9 has a collection chamber 9A encircling the exhaust outlet end of the casing 7 to upwardly collect the exhaust 3 having passed through the filter 5, a mixing pipe 9B which guides the exhaust 3 having passed through the chamber 9A to a vicinity of an exhaust inlet end of the casing 8 in a direction reverse to that of the flow in the casing 7 and a dispersion chamber 9C which encircles the exhaust inlet end of the casing 8 to guide the exhaust 3 having passed through the mixing pipe 9B in laterally dispersed manner into the selective reduction catalyst 6 in the casing 8.

Arranged at the mixing pipe 9B and adjacent to the collection chamber 9A is urea water addition means 10 for addition of urea water to the exhaust 3.

Arranged upstream in the casing 7 is oxidation catalyst 11 for treatment of unburned fuel in the exhaust 3. Arranged downstream in the casing 8 is ammonia reducing catalyst 12 for oxidization treatment of surplus ammonia.

In the exhaust emission control device, the casings 7 and 8 within each of which the exhaust 3 flows in the fore-and-aft direction of the vehicle are arranged side by side laterally of the vehicle and the mixing pipe 9B is positioned above the casing 8 so as to prevent the overall device from becoming oversized both in the fore-and-aft direction and laterally of the vehicle, which makes it possible to improve the mountability on the vehicle, prolong the distance from the added position of the urea water to the selective reduction catalyst and substantially ensure time for decomposition of the urea water added to the exhaust 3 into ammonia and carbon dioxide.

An exhaust emission control device with a filter for capture of particulates and a selective reduction catalyst arranged side by side has been proposed for example in the following Patent Literature 1.

[Patent Literature 1] JP 2005-155404A

SUMMARY OF INVENTION

Technical Problems

For the casings 7 and 8, a sensor must be arranged to obtain data such as internal temperature and $NO_x$ concentration. The exhaust 3 flowing sideways in the dispersion chamber 9C enters into the casing 8 through perpendicular turnabout in flow direction, which may cause nonuniformity of flow velocity distribution and stagnation of the exhaust 3 in the casing 8 specifically when the engine is in idle state and the exhaust 3 has lower flow rate.

Thus, inappropriately selected attachment position of the sensor to the casing 8 may cause erroneous detection of data.

The invention has its object to provide an exhaust emission control device with a sensor arranged at a position where no erroneous detection of data occurs.

Solution to Problems

In order to attain the above object, in a first aspect of the invention, it comprises a cylindrical body for encasing a catalyst carrier, a pipe in parallel with said cylindrical body, a dispersion chamber for encircling an exhaust inlet end of said cylindrical body to guide engine exhaust having passed through the pipe to the exhaust inlet end of the cylindrical body and a sensor attached to said cylindrical body, attachment position of the sensor to the cylindrical body being set to a part region of a 360° region around an axis of the cylindrical body when viewed from the exhaust inlet end of the cylindrical body, said part region being opposite to the pipe with respect to a border line perpendicular to an exhaust-flow center line connecting axes of the pipe and of the cylindrical body and crossing said axis of the cylindrical body to extend diametrically of the cylindrical body.

In a second aspect of the invention, it comprises a cylindrical body for encasing a catalyst carrier, a pipe in parallel with said cylindrical body, a dispersion chamber for encircling an exhaust inlet end of said cylindrical body to guide engine exhaust passed through the pipe to the exhaust inlet end of the cylindrical body and a sensor attached to said cylindrical body, said cylindrical body being arranged closely adjacent to a bottom surface of a vehicle body and adjacent to a side of the vehicle, the cylindrical body and the pipe being relatively positioned such that an exhaust-flow center line connecting axes of the pipe and of the cylindrical body extends laterally, attachment position of the sensor to the cylindrical body being set to a part region of a 360° region around the axis of the cylindrical body when viewed from the exhaust inlet end of the cylindrical body, said part region being opposite to the pipe with respect to a border line perpendicular to the exhaust-flow center line and extending from the axis of the cylindrical body radially upwardly, said part region being between a position coming close from the border line to the exhaust flow center line by an angel of 23° and a position coming close from the exhaust-flow center line to the border line by an angle of 23°.

Advantageous Effects of Invention

According to an exhaust emission control device of the invention, the following excellent effects and advantages can be obtained.

(1) In either of the first and second aspects of the invention, the attachment position of the sensor to the cylindrical body is set to the part region opposite to the pipe with respect to the border line based on the exhaust-flow center line and the axis of the cylindrical body where the exhaust flows fast and no stagnation occurs, so that no erroneous data detection bye the sensor occurs even if the exhaust has a low flow rate.

(2) In the second aspect of the invention, the attachment position of the sensor to the cylindrical body is set, with respect to the border line based on the lateral exhaust-flow center line and the axis of the cylindrical body, between the position coming close from the border line to the exhaust flow center line by the angle of 23° and the position coming close from the exhaust flow center line to the border line by the angle of 23°, so that the sensor itself and an associated wire harness do not protrude laterally of the vehicle and do not interfere with the bottom surface of the vehicle body.

REFERENCE SIGNS LIST

3 exhaust (engine exhaust)
8 casing (cylindrical body)
9B mixing pipe (pipe)
9C dispersion chamber
14 bottom of bed (bottom of vehicle body)
15 sensor
16 side of bed (portion adjacent to side of vehicle)
e1 exhaust-flow center line
x1 axis of casing (axis of cylindrical body)
x2 axis of mixing pipe (axis of pipe)
y1 border line
α a region
β region

DESCRIPTION OF EMBODIMENTS

An embodiment of the invention will be described in conjunction with drawings.

Figure 1:
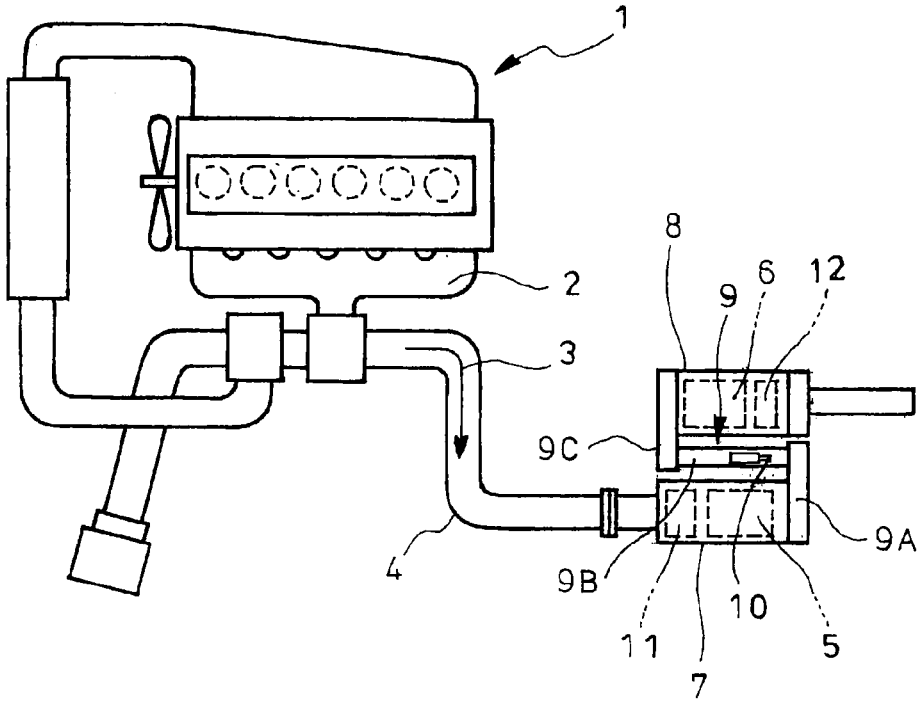
FIG. 1 shows a schematic view of an internal combustion engine with a conventional exhaust emission control device.
Figure 2:
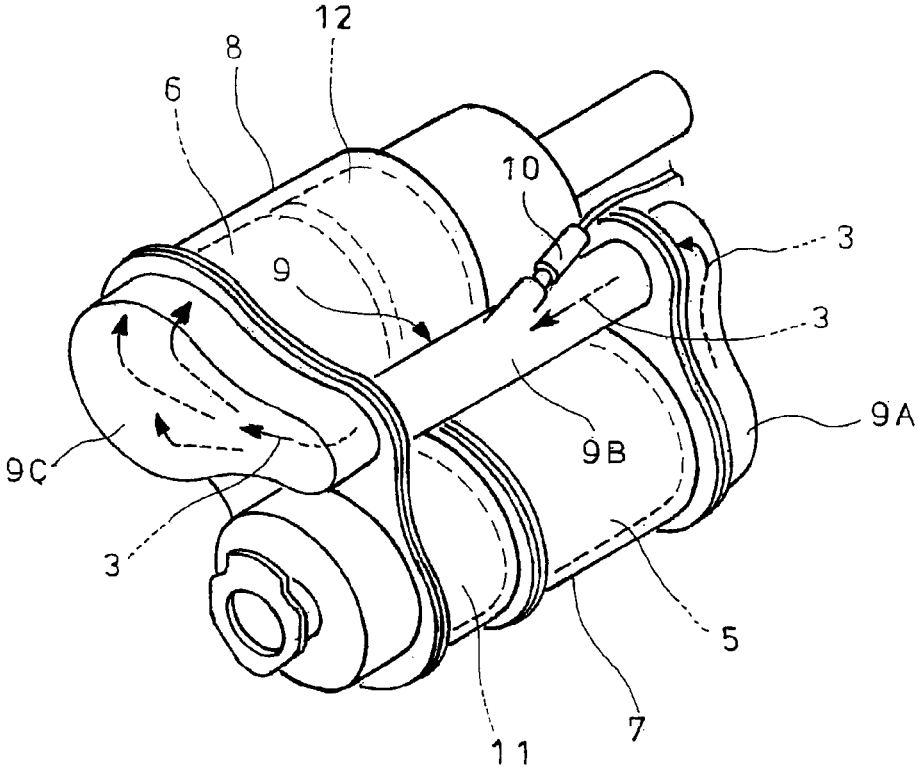
FIG. 2 is a perspective view showing the conventional exhaust emission control device.
Figure 3:
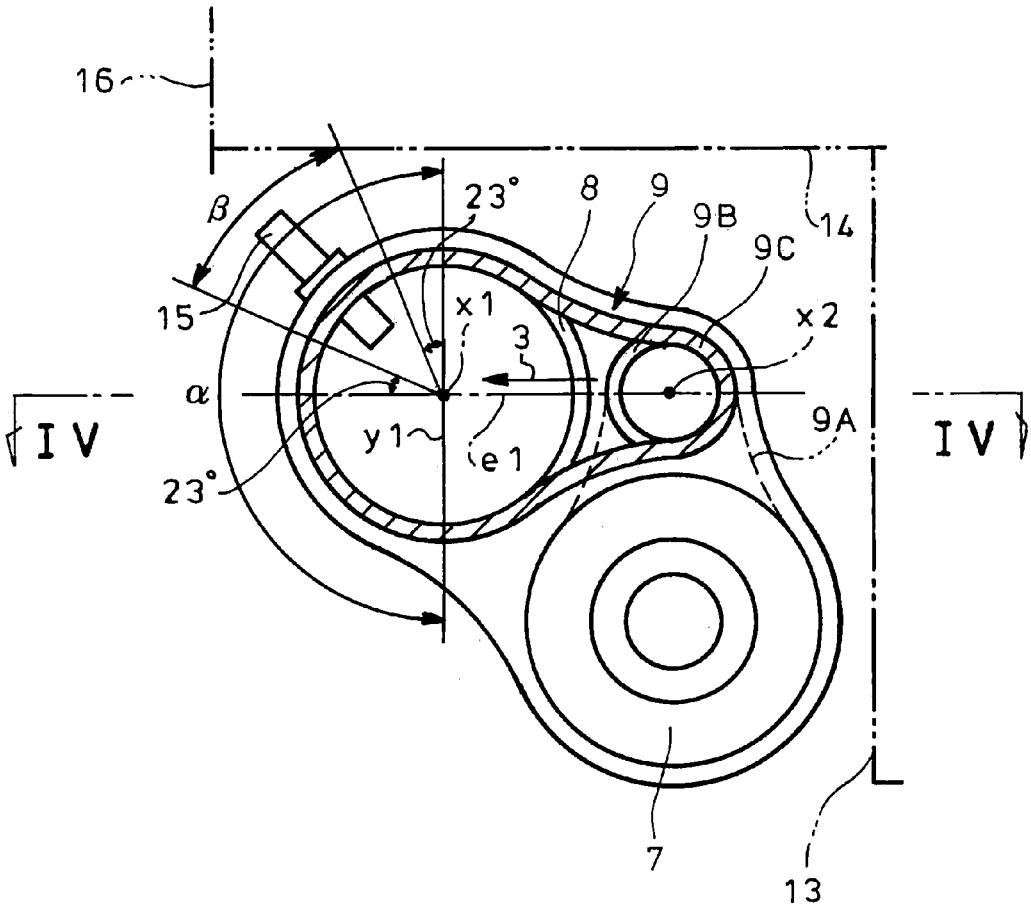
FIG. 3 is a partial vertical section of an exhaust emission control device according to an embodiment of the invention.
Figure 4:
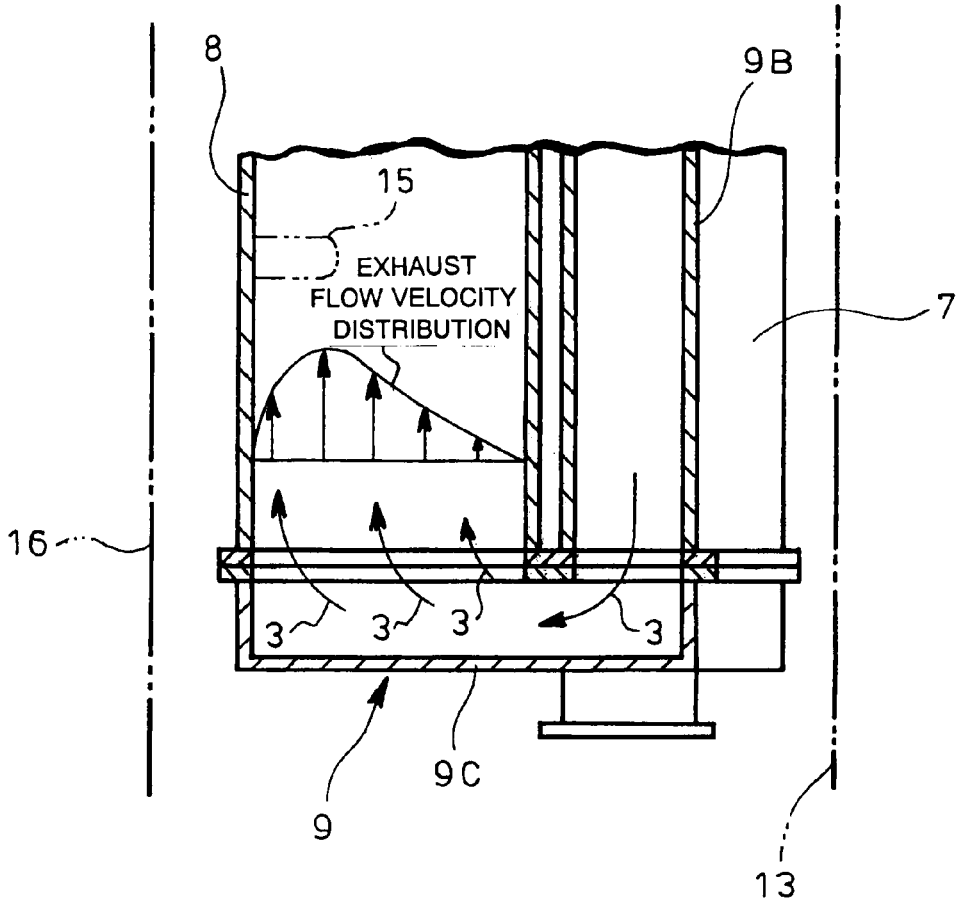
FIG. 4 is a view looking in the direction of arrows IV in FIG. 3.

FIGS. 3 and 4 show the embodiment of an exhaust emission control device of the invention in which parts similar to those in FIGS. 1 and 2 are represented by the same reference numerals.

In the exhaust emission control device, a casing 7 encasing a filter for capture of particulates, and a casing 8 encasing a selective reduction catalyst are arranged side by side and an exhaust exit end of the casing 7 is connected to an exhaust inlet end of the casing 8 through a communication passage 9.

The casing 7 extends in a fore-and-aft direction of a vehicle (truck) and is arranged closely adjacent to a side 13 of a side member of a frame. The casing 8 extends in the fore-and-aft direction of the vehicle and is arranged closely adjacent to a bottom of bed 14 so as to be positioned laterally outwardly of the vehicle to the casing 7. Moreover, the casing 8 has a sensor 15 attached thereto so as to obtain data such as internal temperature and NO concentration.

The communication passage 9 has a collection chamber 9A which encircles the exhaust outlet end of the casing 7 to upwardly collect the exhaust 3 having passed through the filter, a mixing pipe 9B which guides the exhaust 3 having passed through the collection chamber 9A into vicinity of the exhaust inlet end of the casing 8 and a dispersion chamber 9C which encircles the exhaust inlet end of the casing 8 and guides the exhaust 3 having passed through the mixing pipe 9B in laterally dispersed manner into the selective reduction catalyst in the casing 8.

In a 360° region around an axis x1 of the casing when viewed from the exhaust inlet end of the casing 8, attachment position of the sensor 15 is set to a part region a which is at least opposite to the mixing pipe 9B with respect to a border line y1 which is perpendicular to an exhaust-flow center line e1 connecting an axis x2 of the mixing pipe and the axis x1 of the casing and crosses the axis x1 of the casing to extend diametrically of the casing 8.

Specifically, the more radially outward, the faster the curved flow of the exhaust 3 from the dispersion chamber 9C to the casing 8 is. As a result, the attachment position of the sensor 15 set to the above-mentioned part region a causes no stagnation and no erroneous data detection by the sensor 15 occurs even if the exhaust 3 has a fewer flow rate.

More preferably, the attachment position of the sensor 15 is limitatively set to a part region β which is opposite to the mixing pipe 9B with respect to the border line y1 and is between a position coming close from the border line y1 to the center line e1 by an angle of 23° and a position coming close from the center line e1 to the border line y1 by an angle of 23°.

The part region β does not include a region below the center line e1, which can prevent damage of the sensor 15 by means of any flying stone knocked over by a tire.

Moreover, the region β does not include a region between the exhaust-flow center line e1 and the position coming close from the exhaust-flow center line e1 to the border line y1 by the angle of 23°, so that the sensor 15 itself and the associated wire harness do not protrude outward of a side 16 of a bed. Further, the region β does not include a region between the border line y1 and the position coming close from the border line y1 to the exhaust-flow center line e1 by the angle of 23°, so that sensor 15 itself and the associated wire harness do not interfere with the bottom 14 of the bed.

It is to be understood that an exhaust emission control device of the invention is not limited only to the above-mentioned embodiment and that various changes and modifications may be made without leaving a scope of the invention.

INDUSTRIAL APPLICABILITY

An exhaust emission control device of the invention may be applicable to various kinds of vehicles.

The invention claimed is:

1. An exhaust emission control device, characterized in that it comprises a cylindrical body for encasing a catalyst carrier, a pipe in parallel with said cylindrical body, a dispersion chamber for encircling an exhaust inlet end of said cylindrical body to guide engine exhaust having passed through the pipe to the exhaust inlet end of the cylindrical body and a sensor attached to said cylindrical body, attachment position of the sensor to the cylindrical body being set to a part region of a 360° region around an axis of the cylindrical body when viewed from the exhaust inlet end of the cylindrical body, said part region being opposite to the pipe with respect to a border line perpendicular to an exhaust-flow center line connecting axes of the pipe and of the cylindrical body and crossing said axis of the cylindrical body to extend diametrically of the cylindrical body.

2. An exhaust emission control device, characterized in that it comprises a cylindrical body for encasing a catalyst carrier, a pipe in parallel with said cylindrical body, a dispersion chamber for encircling an exhaust inlet end of said cylindrical body to guide engine exhaust passed through the pipe to the exhaust inlet end of the cylindrical body and a sensor attached to said cylindrical body, said cylindrical body being arranged closely adjacent to a bottom surface of a vehicle body and adjacent to a side of the vehicle, the cylindrical body and the pipe being relatively positioned such that an exhaust-flow center line connecting axes of the pipe and of the cylindrical body extends laterally, attachment position of the sensor to the cylindrical body being set to a part region of a 360° region around the axis of the cylindrical body when viewed from the exhaust inlet end of the cylindrical body, said part region being opposite to the pipe with respect to a border line perpendicular to the exhaust-flow center line and extending from the axis of the cylindrical body radially upwardly, said part region being between a position coming close from the border line to the exhaust flow center line by an angle of 23° and a position coming close from the exhaust-flow center line to the border line by an angle of 23°.

* * * * *